US005176452A

United States Patent [19]

Stern

[11] Patent Number: 5,176,452

[45] Date of Patent: Jan. 5, 1993

[54] SELF-CLOSING BAG

[75] Inventor: Marilyn Stern, Washington, D.C.

[73] Assignee: Ninth Moon, Washington, D.C.

[21] Appl. No.: 863,763

[22] Filed: Apr. 6, 1992

Related U.S. Application Data

[63] Continuation-in-part of Ser. No. 680,150, Apr. 3, 1991.

[51] Int. Cl.[5] ..... B65D 33/30

[52] U.S. Cl. ..... 383/43; 63/11; 24/30.5 P; 383/40; 383/89; 446/486

[58] Field of Search ..... 383/43, 905, 89, 90, 383/91, 40, 38; 24/30.5 R, 30.5 P; 446/353, 486; 63/11

[56] References Cited

U.S. PATENT DOCUMENTS

| | | | |
|---|---|---|---|
| 892,330 | 6/1908 | Tavis | 383/905 |
| 1,960,232 | 5/1934 | Corbe | 383/905 |
| 2,232,888 | 2/1941 | Schimelmitz | 383/43 |
| 2,793,743 | 5/1957 | Lefebvre | 383/40 |
| 2,884,980 | 5/1959 | Miller | 150/900 |
| 3,142,437 | 7/1964 | Grant et al. | 383/40 |
| 3,201,030 | 8/1965 | Pollack | 383/43 |
| 3,217,934 | 11/1965 | Schneider et al. | 383/40 |
| 3,410,023 | 11/1968 | Anello | 446/486 |
| 3,537,636 | 11/1970 | Rochette | 383/905 |
| 3,889,871 | 6/1975 | White | 383/905 |
| 4,795,268 | 1/1989 | Jorda | 383/40 |
| 4,997,104 | 3/1991 | Pohl | 383/43 |

FOREIGN PATENT DOCUMENTS

| | | | |
|---|---|---|---|
| 2447328 | 9/1980 | France | 383/40 |
| 37355 | 2/1989 | Japan | 383/38 |

*Primary Examiner*—Stephen P. Garbe
*Attorney, Agent, or Firm*—Dickstein, Shapiro & Morin

[57] ABSTRACT

A self-closing bag is disclosed as having front and rear sidewalls which are interconnected at their side edges and top and bottom. A spring strip holder in the form of a longitudinal slot extends from near a top edge to near a bottom edge of the bag on at least one of the front and rear sidewalls. The holder is designed to accept a self-rolling spring strip which has a concave top surface and convex bottom surface. The spring strip has the property of remaining straight when unrolled but self-rolling when it is slightly bent from its straight condition. The spring strip when provided in the bag serves to roll the top of the bag down to seal the bag once it is opened. When the bag is reopened, the user may straighten the spring strip again to thereby hold the bag in its opened condition.

33 Claims, 3 Drawing Sheets

SELF-CLOSING BAG

CROSS REFERENCE TO RELATED APPLICATION

This application is a continuation-in-part of U.S. application Ser. No. 680,150, filed on Apr. 3, 1991.

BACKGROUND OF THE INVENTION

1. Field of the Invention

The present invention is directed to the field of self-closing bags of the type used for storing various commodities including food products such as potato chips, corn chips, cookies, etc.

2. Brief Discussion of the Prior Art

Various bag closures are known in the art for securing food commodities and keeping them fresh once a sealed bag is opened to provide access to the bag contents. Some bags are provided with closure tabs adjacent their top edge which are unfolded when the bags are opened and which, after the top of the bag is manual rolled down, engage with the rolled-up side walls of the bag to hold the bag closed to secure the bag contents and preserve food freshness.

Some bags contain no such closure structures and therefore when the bags are rolled down they often unroll so the bag contents are not secure and air and airborne contaminants are allowed in which accelerates the loss of food product freshness. To help secure the latter type of open bag in a closed position, various types of clips and external closure devices have been provided.

A problem with these bag closing structures is that the user must remember to roll down the bag and then reseal it with the closure member, whether it is provided as part of the bag or separate from the bag. Often a user fails to do this, either not closing the bag, or hastily closing the bag so that it is not properly closed, permitting spilling of bag contents and accelerating the loss of food freshness.

SUMMARY OF THE INVENTION

The present invention has been designed to overcome the foregoing problems with known bag closing structures.

The principle feature of the invention is to provide a self-closing bag structure which includes a spring strip holder which is adapted to hold a self-coiling spring strip against a bag sidewall the spring strip has a biasing such that when unrolled and straightened, the spring strip maintains its straightened shape, but when the strip is bent, initiation of coiling occurs and the spring strip self-rolls into a coiled shape. Holding the spring strip at a bag sidewall of the bag provides a bag which, once opened, is easily closed by merely bending the spring-strip strip allowing the strip, and attached wall of the bag to roll upon itself to thereby provide a contents-securing closure of the bag. The holder is preferably arranged as a channel extending along a bag sidewall into which the spring strip is inserted.

The spring strip may be provided as an integral part of a product-containing bag which is purchased by a consumer. Alternatively, the bag may be provided without the spring-strip and the user may provide his own spring-strip which is held by the holder once the bag is opened.

Since the spring-strip will only roll the bag down to the point where the contents prevent further rolling, the self-closing bag will provide a relatively secure and airtight closure which self-adapts to the level of fill in the bag to retain the bag contents and keep them fresh.

The self-closing bag can be used in many different environments including as a container for food stuffs, as a lunch bag, and as a container for storing and carrying various objects, etc.

Since the spring-strip can be rolled and straightened, with the straightened condition being maintained, a user can have a bag which, when opened and its top unrolled, holds itself open to allow easy access to the bag interior. When the bag top is then bent so the spring-strip is likewise bent to initial its coiling state, the bag self-closes to secure the bag contents and help preserve freshness.

The spring-strip and associated holder may extend along all or part of the length of the self-closing bag.

The self-closing bag is easily constructed from readily available materials and manufacturing process and is therefore both inexpensive and readily adapted for different purposes and uses.

The present invention will be more readily understood by reference to the following detailed description of the invention which is provided in connection with the accompanying drawings.

DETAILED DESCRIPTION OF THE DRAWINGS

Figure 1:
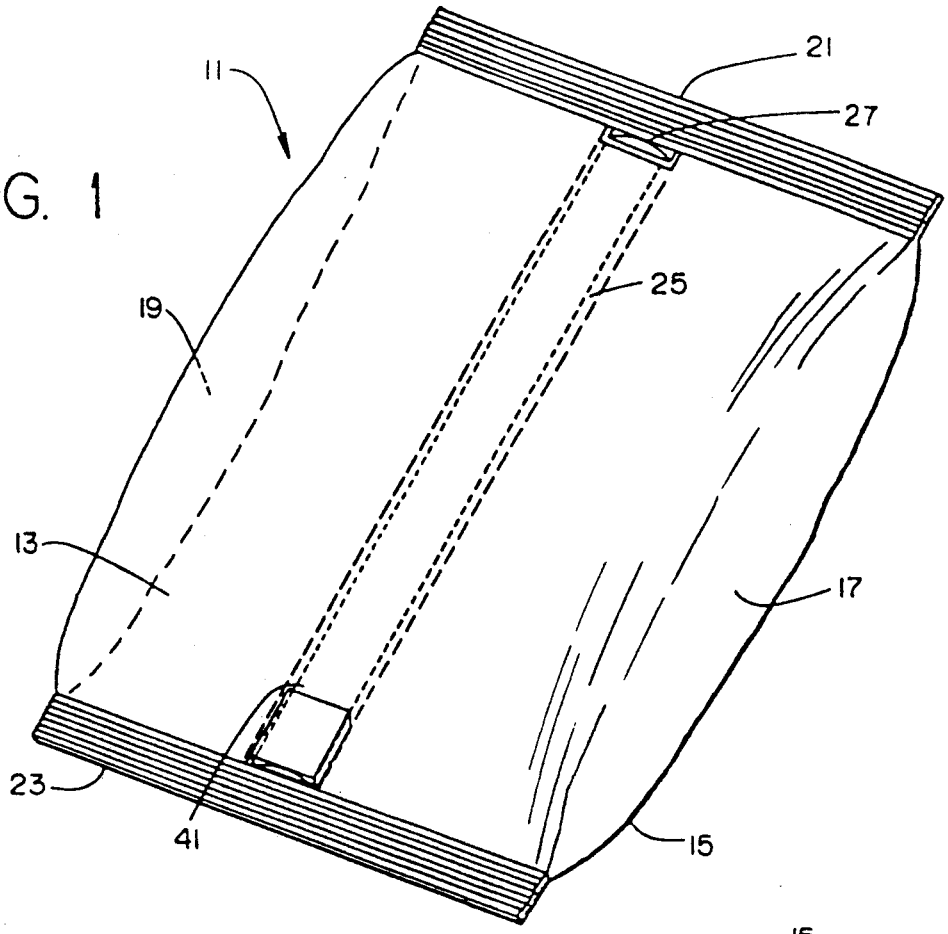
FIG. 1 is a perspective view of a self-closing bag incorporating the invention.

Referring to FIGS. 1–7 of the drawings, a first embodiment of the present invention is shown as a self-closing bag 11 having front and rear sidewalls 13 and 15 which are joined along side edges 17 and 19 and which are also sealed along a top edge 21 and bottom edge 23. The bag 11 illustrated in FIG. 1 is shown as sealed, that is, in the condition it takes when purchased by a consumer containing, for example, a food product therein. The front and rear sidewalls 13, 15 may be made of various materials such as plastic or paper and may be transparent or opaque.

Figure 2:
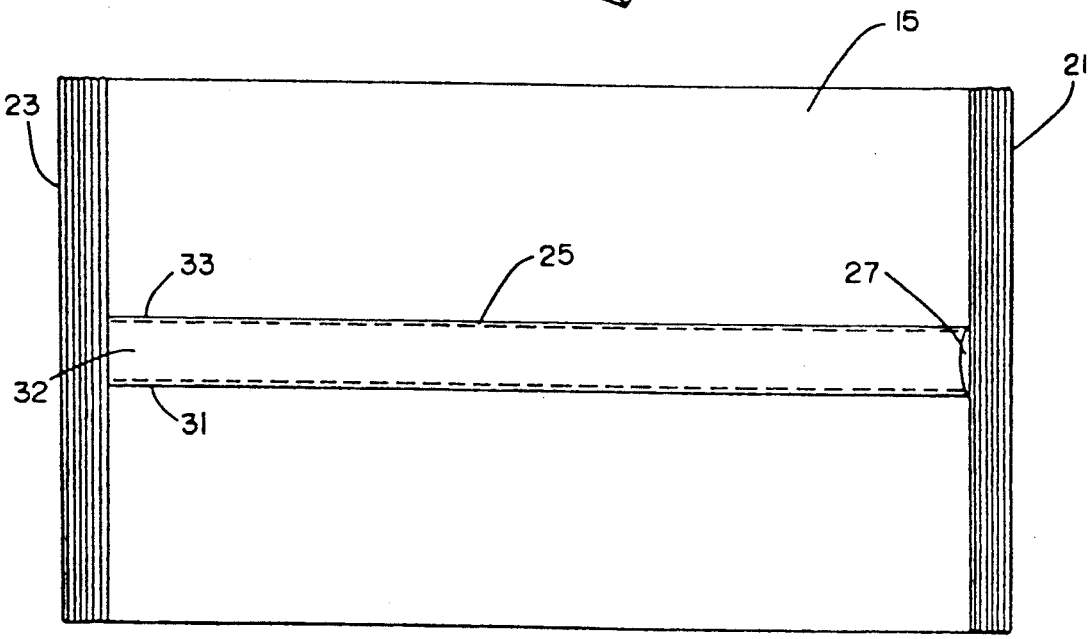
FIG. 2 is a bottom view of the bag illustrating a holder for a self-coiling spring strip.
Figure 4:
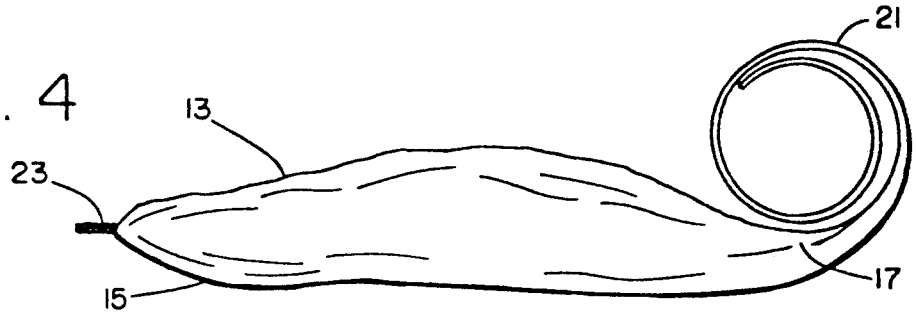
FIG. 4 illustrates the FIG. 1 bag in side view in partially rolled-up condition.

Bag 11 is also provided on one of the front and rear sidewalls with a strip holder 25. As shown in FIGS. 1, 2 and 4, the strip holder 25 is preferably provided on the rear sidewall 15. The strip holder 25 is in the form of a channel extending longitudinally of the rear sidewall 15 from a point approximately adjacent top edge 21 to a point approximately adjacent bottom edge 23. The strip holder 25 is preferably formed of the same material as the bag sidewalls and has a top opening 27 adjacent top edge 21 of bag 11. Opening 27 is provided to allow the insertion of a self-rolling spring strop 41 into holder 25. Spring strip 41 is known in the art and is commonly used in steel roll tape measures and, more recently, has been commonly used in so-called "slap" wrist bracelets popular among young children. The spring strip 41 is described in greater detail in U.S. Pat. No. 3,410,023, the disclosure of which is incorporated herein by reference. Spring-strip 41 may be made of metal or plastic materials.

Figure 5A:
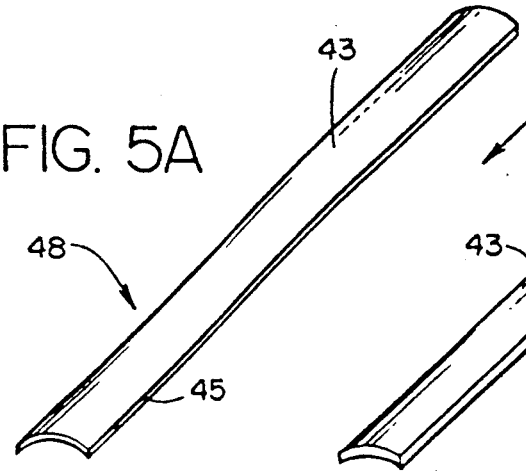
FIGS. 5*a* and 5*b* illustrate a self-rolling spring strip in an unrolled and rolled state which is used with the invention.
Figure 5B:
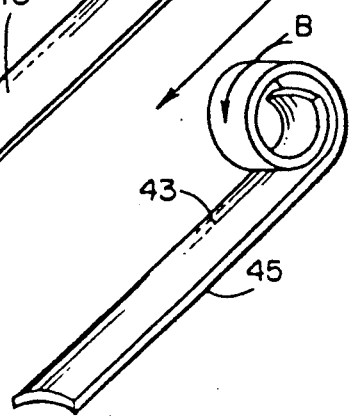

As shown in FIGS. 5*a* and 5*b*, the self-rolling spring strip 41 includes a concave surface 43 and a convex surface 45. When straightened, the concave/convex surfaces tend to keep the self-rolling strip 41 straight. However, once a bending of the strip 41 is initiated, it self-rolls itself as illustrated in FIG. 5*b*. The FIG. 5*b*, the Arrow A illustrates the rolling direction of one end of the self-rolling spring strip 41 towards the other end while Arrow B illustrates the bending direction to initiate self-rolling.

During manufacture of the bag 11, the strip holder 25 may be formed separately and then attached to the rear sidewall 15 of bag 11 such as by adhesives, ultrasonic welding, heat sealing or other available fastening techniques, or it may be formed integrally with the manufacture of bag 11. For example, the body of bag 11 include the front and rear sidewalls 13, 15 may be created by forming a material tube by overlapping side edges of a flat material. If this overlapping is formed at the back of the bag 11, as shown in FIG. 2 view, the strip holder 25 may be formed by the overlapped area 32 with seams 31 and 33 being provided along the entire length of strip holder 25. The overlapped area 32 and seams 31, 33 would thus form the strip holder 25. The bottom edge 23 may then be created by flattening the tube and pressing and fastening one end of the flattened tube. After the thus formed bag is filled with a commodity the top edge 21 can be formed by pressing and fastening the other end of the tube. Opening 27 is formed in holder 35 before the top edge 21 is formed to enable receipt of a spring-strip 41 before the top edge 21 is sealed. Alternatively, if a user supplies the spring-strip 41, then opening 27 may be formed at the time the top edge 21 is opened by a user.

Figure 3:
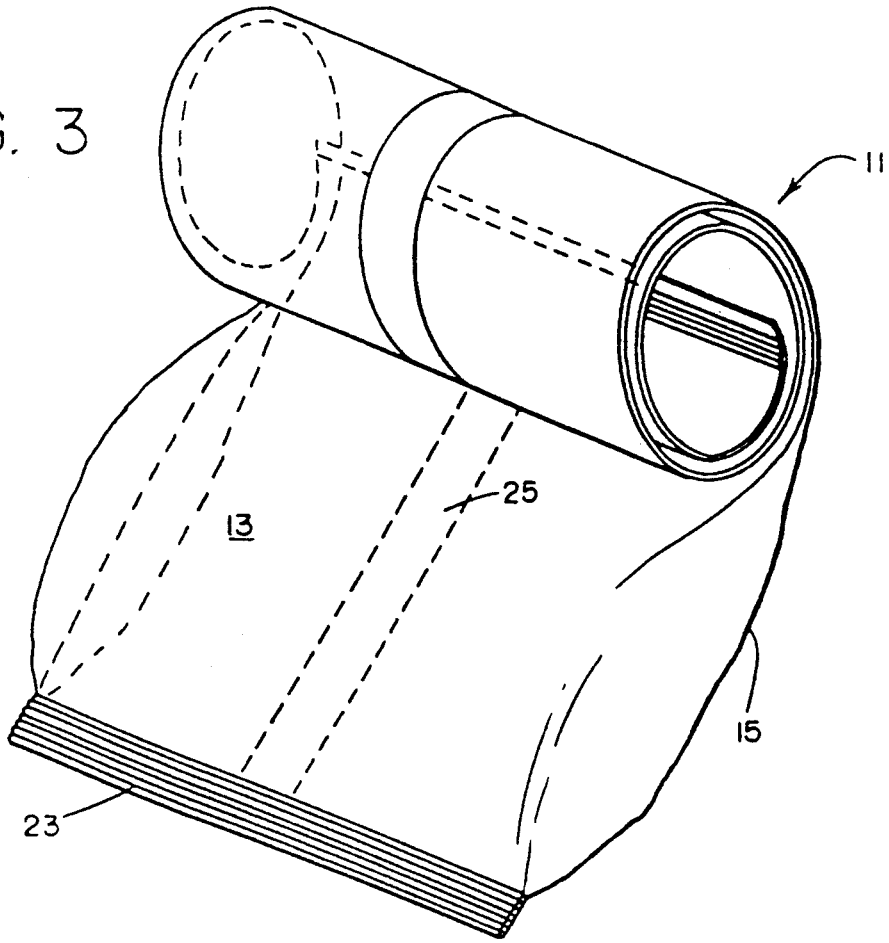
FIG. 3 illustrates the FIG. 1 bag in a partially rolled-up condition.

Bag 11 may be manufactured and supplied either with or without a self-rolling spring strip 41 inserted into the strip holder 25. If a strip holder 41 is provided, it is inserted through opening 27 and held by strip holder 25. The bag is otherwise assembled and filled with commodities using conventional techniques. In use, when top edge 21 is opened by a commodity user, the contents of the bag may be removed. Thereafter, when it is desired to close the bag, the front and rear side walls 13 and 15 are pushed together near the top and the spring strip 41 is slightly bent to cause it to begin to self-roll which will in turn cause a roll-up of the top edge of bag 11, as illustrated in FIG. 3. The self-rolling will continue until the contents of the bag prevent a further roll-up of the spring strip 41.

If a user supplies spring-strip 41, then the opening 27 of holder 25 is created when the top edge 21 is opened by a user. The user then inserts the spring-strip 41 into the holder 25 through opening 27. Thereafter, closing the bag occurs in the same manner as described in the preceding paragraph.

The roll-up power of string-strip 41 will vary in accordance with the width of the strip and its thickness and it is therefore easy to provide spring-strip 41 with different roll-up force for different requirements of use. If the user supplies the spring-strip 41, the same spring strip 41 may then be removed after the contents of the bag are consumed and used in another similar self-closing bag having a strip holder 25.

An additional advantage of the invention is that the self-roll spring-strip 41 may be straightened when the bag is open to hold the bag in an opened and straightened condition to provide easy access to the bag contents. Thereafter, when the user is finished removing commodities from the bag, he may close the bag by merely bending the spring-strip 41 to achieve the self-closing feature.

Figure 6:
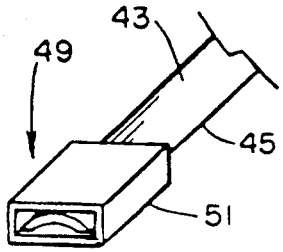
FIG. 6 illustrates a modification to an end of the spring-strip depicted in FIGS. 5*a* and 5*b;*

In order to ensure that spring-strip 41 rolls from the top edge 21 of the bag, rather than from bottom edge 23, spring-strip 41 is also preferably provided at its one end 49 which is set adjacent the bottom edge 23 with a roll inhibiting device 51 which inhibits a bending of spring-strip 41 near the bag bottom. This device, as shown in FIG. 6, prevents the widthwise expansion of the spring-strip 41 at end 49 and along the length of roll inhibiting device 51, which, in turn, prevents the bending and the initiation of the rolling of spring-strip 41 from end 49. The device 51 may be an inflexible tubular sleeve which press fits over the end 49 of the strip 41 to prevent widthwise expansion and thus bending of end 49, or may even be a simple winding of inextensible tape or other materials around end 49.

The presence of roll inhibiting device 51 at end 49 ensures that the initiation of rolling of strip 41 and self-closure of the bag can only occur from the top of the bag downwards.

It is also noted that the self-rolling occurs on the convex side of spring-strip 41. Therefore, it is preferable to have the convex side of the spring-strip 41 face the interior of the bag so that the self-rolling of the spring-strip 41 more easily pulls along both bag sidewalls 13, 15.

The holder 25 in the FIGS. 1–6 embodiments of the invention is formed as a channel extending the length of bag 11. As a modification, the spring-strip 41 may also be held to the bag sidewall by adhesive, glue, tape or other fasteners. Such fasteners may be used along the entire length of spring-strip 41 or only at selected locations along its length.

Figure 7:
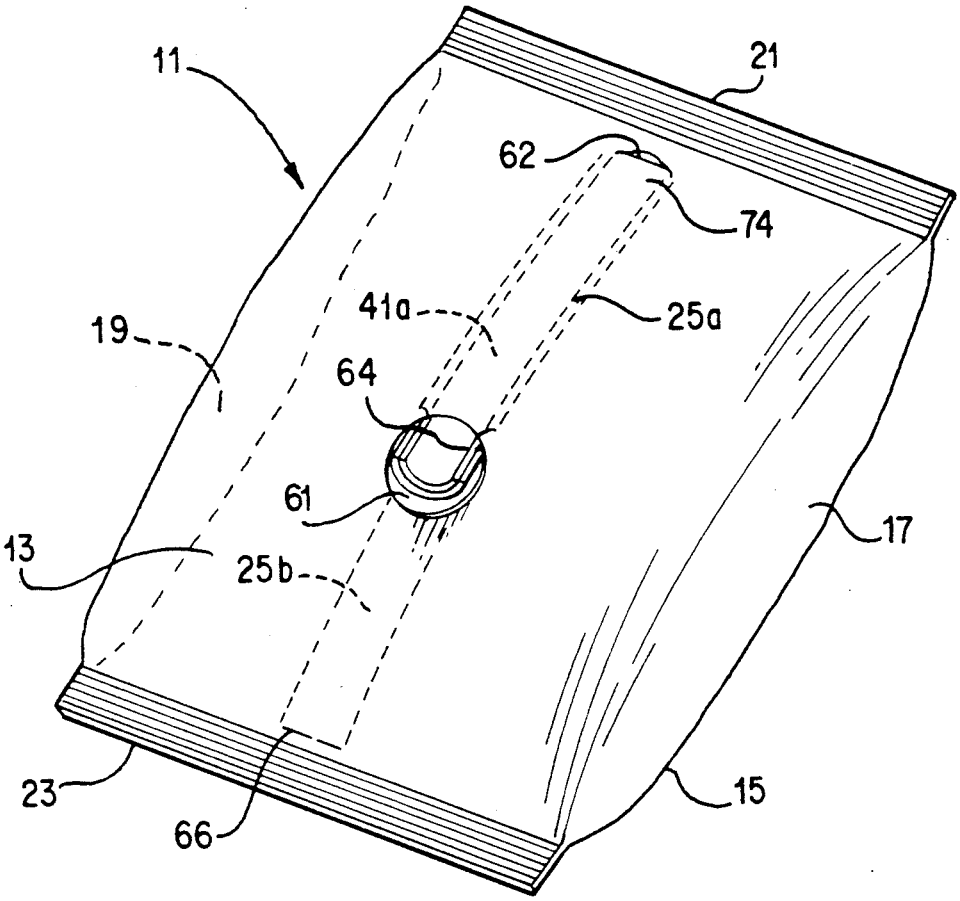
FIG. 7 is a perspective view of a modified self-closing bag incorporating the invention.
Figure 9:
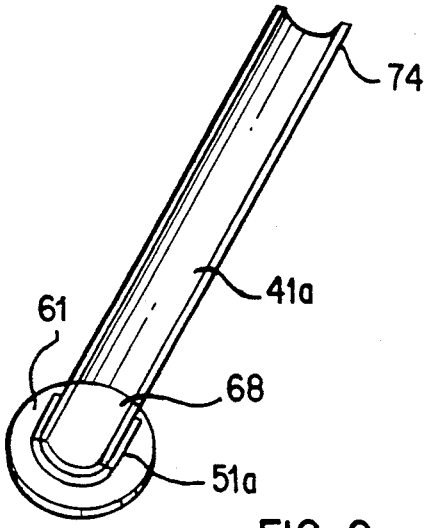
Figure 8:
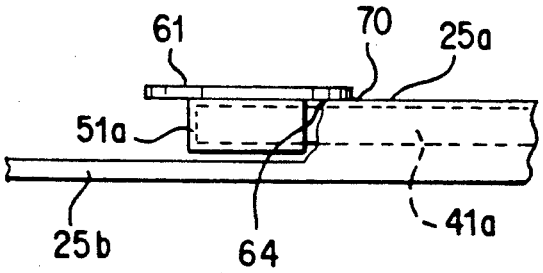
FIG. 8 is an enlarged side view of a portion of the bag shown in FIG. 7; and, FIG. 9 is a perspective view of a self-rolling spring strip used in the FIG. 7 embodiment.

FIGS. 7–9 illustrate a modified embodiment of the invention wherein like elements to those in FIGS. 1–6 bear the same reference numbers. In FIG. 7 the spring-strip holder is illustrated as being formed by two separate holders 25*a* and 25*b*. As in the prior embodiment, a channel extends lengthwise of the bag from a point adjacent to top edge 21 to point approximately adjacent bottom edge 23. In FIG. 7 the channel contains three slots 62, 64 and 66 near the top, middle and bottom of the channel. The three slots actually divide the channel into the two distinct spring strip holders 25*a* and 25*b*, each extending for about half of the length of bag 11.

A spring-strip 41*a* is inserted into middle slot 64 towards either slot 62 or 66. FIG. 7 illustrates the spring-strip 41*a* inserted towards slot 62. As FIG. 7 illustrates, the spring-strip 41*a* does not run the entire length of bag 11, it being sufficient if it extends at least about half of the length of bag 11.

Spring-strip 41*a*, like spring-strip 41, has opposite concave and convex sides and has two stable states, a straight unrolled state and a bent-self-rolled state. It also contains at one end 68 a roll inhibiting device 51*a* which inhibits a bending of the spring-strip 41*a*. Device 51*a* prevents widthwise expansion of spring-strip 41*a* which prevents the bending and initiation of rolling of spring-strip 41*a* from end 68. Device 51*a* has a similar construction and function as device 51 described above.

A disk member 61 is also provided at the end 68 of spring-strip 41*a*. Disk member 61, which may be transparent, as illustrated in FIGS. 7 and 9 provides a convenient surface area for printed advertising or promotional information, and extends over spring-strip 41*a* to provide a nip 70 between the undersurface of disc member 61 and an opposing surface of spring-strip 41*a*. This nip is used to grab onto an edge of holder 25*a* adjacent slot 64 to hold spring-strip 41*a* in position in channel 25*a*. The nip also provides an insertion stop which limits the extent to which spring-strip 41*a* can be inserted into a channel (25*a* or 25*b*).

In use, the spring-strip 41*a* is inserted through slot 64 into either holder 25*a* or holder 25*b*, depending on which edge 21 or 23 of the bag 11 is opened. FIG. 7 illustrates the position of spring-strip 41*a* when the top edge 21 is to be opened. In order to close an opened bag, the spring strip 41 is bent at or near end 74 to initiate self rolling which rolls and closes bag 11.

As is self-evident, the spring-strip 41*a* and its associated holder (25*a* or 25*b*) extends along only a portion of the length of bag 11. However, this is sufficient to obtain a self-closing bag as the bag will self-roll for closing at least to the end 68 of the spring-strip 41*a*.

Although the invention has been described using specific structures, it should be appreciated that many modifications may be made thereto without the departing from its spirit and scope. Accordingly, the invention is not limited by the foregoing description but is only limited by the scope of the appended claims.

I claim:

1. A self-closing bag comprising:

front and rear sidewalls interconnected along their bottoms and opposite side edges;

at least one of said sidewalls containing a bag closure holder extending longitudinally therealong from a point approximate to a top edge thereof to a point approximate to a lower edge thereof; and a self-coiling spring strip held by said holder, said spring strip operating to self-roll to thereby roll-up said sidewalls and close said bag, said self-coiling spring strip having a concave side and a convex side and the property that, when straightened, it holds its straightened shape, and when bent in a predetermined direction, it self-rolls to close said bag.

2. A self-closing bag as in claim 1, wherein said holder is formed as a channel having an opening at one end of said holder which is closest to one of a top and bottom edge of said at least one sidewall, said self-coiling spring strip insertable into said removable from said channel through said opening.

3. A self-closing bag as in claim 1, further comprising means attached to a portion of said spring-strip to prevent an initiation of self-rolling of said strip at said portion.

4. A self-closing bag as in claim 3, wherein said spring strip has a length which is less than the length of said bag and which is provided along a portion of a sidewall of said bag.

5. A self-closing bag as in claim 3, further comprising gripping means attached to a portion of said spring strip for gripping an edge around said opening in said channel.

6. A self-closing bag as in claim 5, wherein said gripping means includes a flat surface for displaying information.

7. A self-closing bag as in claim 6, wherein said holder is formed of a channel extending longitudinally of said bag, said channel having an opening at an intermediate point thereof to enable insertion of said spring strip into said channel in two different longitudinal directions.

8. A self-closing bag as in claim 1, wherein said bag closure holder is provided substantially midway of the side edges of said at least one sidewall.

9. A self-closing bag as in claim 1 wherein said holder is formed as a channel having an opening, said spring strip being insertable into and removable from said channel through said opening.

10. A self-closing bag comprising:

front and rear sidewalls interconnected along their bottoms and opposite side edges;

at least one of said sidewalls containing a bag closure holder extending longitudinally therealong from a point approximate to a top edge thereof to a point approximate to a lower edge thereof;

a self-coiling spring strip held by said holder, said spring strip operating to self-roll to thereby roll-up said sidewalls and close said bag, said spring-strip having a concave side and a convex side and said spring-strip being mounted in said holder with said convex side facing the bag interior.

11. A self-closing bag as in claim 10, further comprising means attached to a portion of said spring-strip to prevent an initiation of self-rolling of said strip at said portion.

12. A self-closing bag as in claim 11, further comprising gripping means attached to a portion of said spring strip for gripping an edge around said opening in said channel.

13. A self-closing bag as in claim 12, wherein said gripping means includes a flat surface for displaying information.

14. A self-closing bag as in claim 13, wherein said holder is formed of a channel extending longitudinally of said bag, said channel having an opening at an intermediate point thereof to enable insertion of said spring strip into said channel in two different longitudinal directions.

15. A self-closing bag as in claim 11, wherein said spring strip has a length which is less than the length of said bag and which is provided along a portion of a sidewall of said bag.

16. A self-closing bag as in claim 10, wherein said bag closure holder is provided substantially midway of the side edges of said at least one sidewall.

17. A spring strip for use in a self-closing structure, said spring strip comprising:

an elongated self-coiling member having a concave side, a convex side, and a width which expands when said self-coiling member self rolls, said elongated member having two stable states, a first when said member is straightened and a second when said member is bent from a straightened state to initiate and promulgate self-coiling; and, means provided on at least a portion of said elongated member for preventing an initiation of self-coiling by said member at said portion.

18. A spring strip as in claim 17, wherein said preventing means prevents a widthwise expansion of said elongated member at said portion.

19. A spring strip as in claim 18 wherein said preventing means is a tubular sleeve.

20. A spring strip as in claim 18 wherein said preventing means is formed by winding an inextensible material about said elongated member at said portion.

21. A spring strip as in claim 17 wherein said portion is at least one end of said member.

22. A spring strip as in claim 21, wherein said spring strip further comprises gripping means for holding said spring strip to a bag.

23. A spring strip as in claim 22, wherein said holding means is provided at said one end of said member.

24. A self-closing bag comprising:

front and rear sidewalls interconnected along their bottoms and opposite side edges;

at least one of said sidewalls containing means for holding a self-coiling spring strip; and a self-coiling spring strip held by said holder in an orientation whereby said spring strip operates to self roll to thereby roll-up said sidewalls and close said bag, said self-coiling spring strip having a concave side and a convex side and the property that, when straightened, it holds its straightened shape, and when bent in a predetermined direction, it self rolls to roll up said sidewalls and close said bag.

25. A self-closing bag as in claim 24, wherein said holder is formed as a channel having an opening at one end of said channel which is closest to a top edge of said at least one sidewall, said self-coiling spring strip being insertable into and removable from said channel through said opening.

26. A self-closing bag as in claim 24, wherein said strip includes means for holding said spring strip to said bag.

27. A self-closing bag as in claim 24, wherein said holder is formed as a channel extending along at least a portion of one of said sidewalls, said channel having an opening near a middle portion of a sidewall of said bag, said spring strip being insertable into and removable from said channel through said opening.

28. A self-closing bag as in claim 27, wherein said spring strip includes means for holding said self-coiling strip to said bag.

29. A self-closing bag as in claim 28, wherein said holding means grips an edge around said opening in said channel.

30. A self-closing bag as in claim 28, wherein said holding means includes a flat surface for displaying information.

31. A self-closing bag as in claim 24, wherein said holder is formed of a channel extending longitudinally of said bag, said channel having an opening at an intermediate point thereof to enable insertion of said spring strip into said channel in two different longitudinal directions.

32. A self-closing bag as in claim 24, wherein said spring strip has a length which is less than the length of said bag and which is provided along a portion of a sidewall of said bag.

33. A self-closing bag as in claim 24, wherein said spring strip includes means for inhibiting self-rolling which is provided at one end of said spring strip.

* * * * *